US005421758A

United States Patent [19]

Watson et al.

[11] Patent Number: 5,421,758

[45] Date of Patent: Jun. 6, 1995

[54] SCUBA FIN

[76] Inventors: Michael P. Watson; John K. Sigler, III, both of P.O. Box 4277, Fayetteville, Ark. 72702

[21] Appl. No.: 107,622

[22] Filed: Aug. 18, 1993

[51] Int. Cl.[6] ..... A63B 31/11

[52] U.S. Cl. ..... 441/61; 441/64

[58] Field of Search ..... 441/61-64

[56] References Cited

U.S. PATENT DOCUMENTS

| | | | |
|---|---|---|---|
| D. 297,754 | 9/1988 | Hwang | D21/239 |
| D. 302,999 | 8/1989 | McCredie | D21/239 |
| 1,202,083 | 10/1916 | Mee | 441/61 |
| 3,072,932 | 1/1963 | Ciccotelli | 441/64 |
| 3,239,857 | 3/1966 | Gwynne | 441/64 |
| 3,810,269 | 5/1974 | Tabata et al. | 441/64 |
| 4,775,343 | 10/1988 | Lamont et al. | 441/64 |
| 4,838,824 | 6/1989 | McCredie | 441/64 |
| 5,163,859 | 11/1992 | Beltrani et al. | 441/64 |

FOREIGN PATENT DOCUMENTS

| | | | |
|---|---|---|---|
| 1175567 | 3/1959 | France | 441/64 |
| 1241394 | 8/1960 | France | 441/64 |
| 2493157 | 5/1982 | France | 441/64 |
| 0676938 | 11/1964 | Italy | 441/64 |
| 0644799 | 9/1968 | Italy | 441/64 |
| 0272114 | 5/1970 | U.S.S.R. | 441/64 |

OTHER PUBLICATIONS

Advertisement: "Swimtails by Swimcraft".

*Primary Examiner*—Sherman Basinger
*Attorney, Agent, or Firm*—Boyd D. Cox

[57] ABSTRACT

A scuba fin has the fin section separated from the foot pocket, and connected thereto by a shaft. The shaft has substantial height, but is of minimal thickness, so that it presents little frontal area to the water. This arrangement enables the scuba fin to pass through water with reduced resistance when swimming. Also, area and mass of the fin are minimized, while still providing an appropriate area to be subjected to water for propulsion. The angle of the fin is offset from the angle of the bottom of the foot pocket, elevating the front end of the fin, so that the likelihood of tripping is substantially reduced. The novel fin reduces effort by a scuba diver, thus enabling increased bottom time, and enables more convenient and confident walking on boat decks or on terra firma.

15 Claims, 2 Drawing Sheets

SCUBA FIN

BACKGROUND OF THE INVENTION

1. Field of the Invention

The present invention relates to a fin worn by scuba divers.

2. Description of the Prior Art

U.S. Design Pat. Nos. 297,754, issued to Chrang Y. Hwang on Sep. 20, 1988, and 302,999, issued to Donald B. McCredie on Aug. 22, 1989, illustrate swim fins which are representative of current practice, Both include vertical ribs providing rigidity. Cleats located on the bottom surface are seen in '754.

U.S. Pat. No. 3,239,857, issued to Frederick H. Gwynne on Mar. 15, 1966, discloses a swim fin having a member connecting the fin to the lower leg. This arrangement redistributes forces over a greater portion of the swimmer's anatomy, thereby reducing peak strain imposed on the foot. The swimmer's burden is thereby eased, thus prolonging the duration of time spent underwater.

Gwynne's fin includes a floor portion of the foot pocket which is disposed at an angle to the fin portion.

U.S. Pat. No. 4,775,343, issued to Mark D. Lamont et al. on Oct. 4, 1988, discloses, among other features, hinged construction which enables the fin portion to assume angularity with respect to the foot pocket. This angularity enables the fin to present minimized surface area, and hence reduced resistance, when moving through the water.

Additional examples of scuba fins are seen in U.S. Pat. No. 1,202,083, issued to John Mee on Oct. 24, 1916; Italian Pat. No. 644,799, dated September, 1962; French Pat. No. 1,241,394, dated August, 1960; and in an advertisement entitled "Swimtails by Swimcraft". Mee '083 discloses an apparatus essentially adapting a web which opens and closes in umbrella fashion to a generally conventional shoe. The Italian reference adapts a conventional ribbed fin to a generally conventional shoe.

U.S. Pat. No. 4,838,824, issued to Donald B. McCredie on Jun. 13, 1989, the French reference and the advertisement illustrate swim fins featuring configuration wherein a foot pocket and a fin are integral, there being a gradual transition from foot pocket to fin. There is no marked delineation between these two components.

U.S. Pat. No. 5,183,859, issued to Gianni Beltrani et al. on Nov. 17, 1992, illustrates swim fins wherein the foot pocket is delineated from the fin portion.

None of the above inventions and patents, taken either singly or in combination, is seen to describe the instant invention as claimed.

SUMMARY OF THE INVENTION

Two important improvements are embodied in the novel scuba fin. The first is that the fin portion is connected to the foot pocket by a caudal shaft which is configured to reduce resistance as the fin is moved vertically through the water while swimming. This is accomplished while maintaining required rigidity maintaining an established orientation between the fin and the foot pocket. The caudal shaft is patterned after a whale's fluke, taking advantage of the perfected, evolutionary hydrodynamic design embodied therein.

A second improvement is that the principal plane of the fin is disposed at an angle with respect to the bottom surface of the foot pocket, such that the fin is angled upwardly, so that the front edge or tip of the fin remains elevated, out of the way of incidental contact with an obstruction.

The entire scuba fin is configured such that all forward facing surfaces are angled such that no frontal area exists which is normal to forward motion. This characteristic reduces drag arising during walking, or similar maneuvering.

The principal benefit of the caudal shaft is that it reduces the resistance to vertical movement of the fin in water, thus allowing a diver to focus effort and energy maximally upon forward propulsion. Overall efficiency of the fin is increased, the diver being not only less likely to suffer from muscle spasms, resulting in potentially dangerous leg cramps, but also reducing energy expenditure, and thus the respiratory rate. Such reduction enables drastic increases in bottom time, which is a major priority in the diving community.

Angularity of the fin and foot pocket has the further benefit of a wearer experiencing a more natural feel when walking on level, solid surfaces, and especially on unstable solid surfaces, such as a boat deck. This increase in confidence stems from the reduced likelihood of the fin contacting and catching on the solid surface, which can easily cause an accident or injury.

Still another benefit of the upward angle of the fin is that thrust is increased during the more powerful kick when swimming, that being the down stroke.

In alternative embodiments, outer surfaces are flat, resulting in sharp, articulated angular joints between adjacent surfaces, or some outer surfaces are curved, which may eliminate some sharp, angular joints.

Accordingly, it is a principal object of the invention to provide a scuba fin configured such that a member attaching the fin portion to the foot pocket provides minimal resistance to passage through water when the scuba fin is kicked.

It is another object of the invention to provide a scuba fin configured to improve thrust during a down stroke kicking motion while swimming.

It is a further object of the invention to provide a scuba fin configured to hold the front edge or tip of the fin elevated, and away from possible entanglement with a floor surface.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
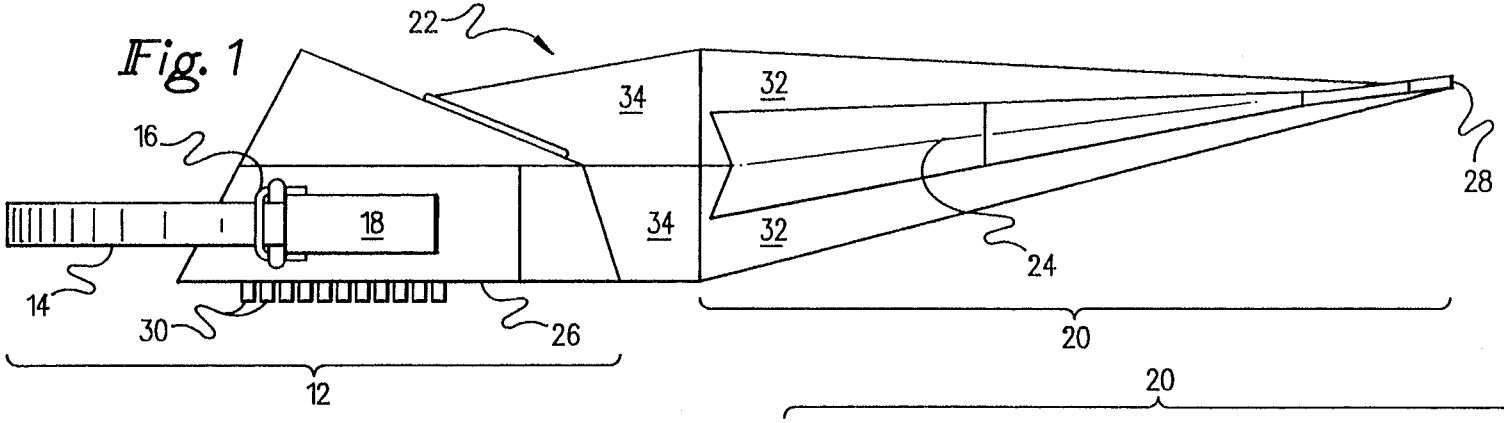
FIG. 1 is a side elevational, diagrammatic view of the novel scuba fin.
Figure 2:
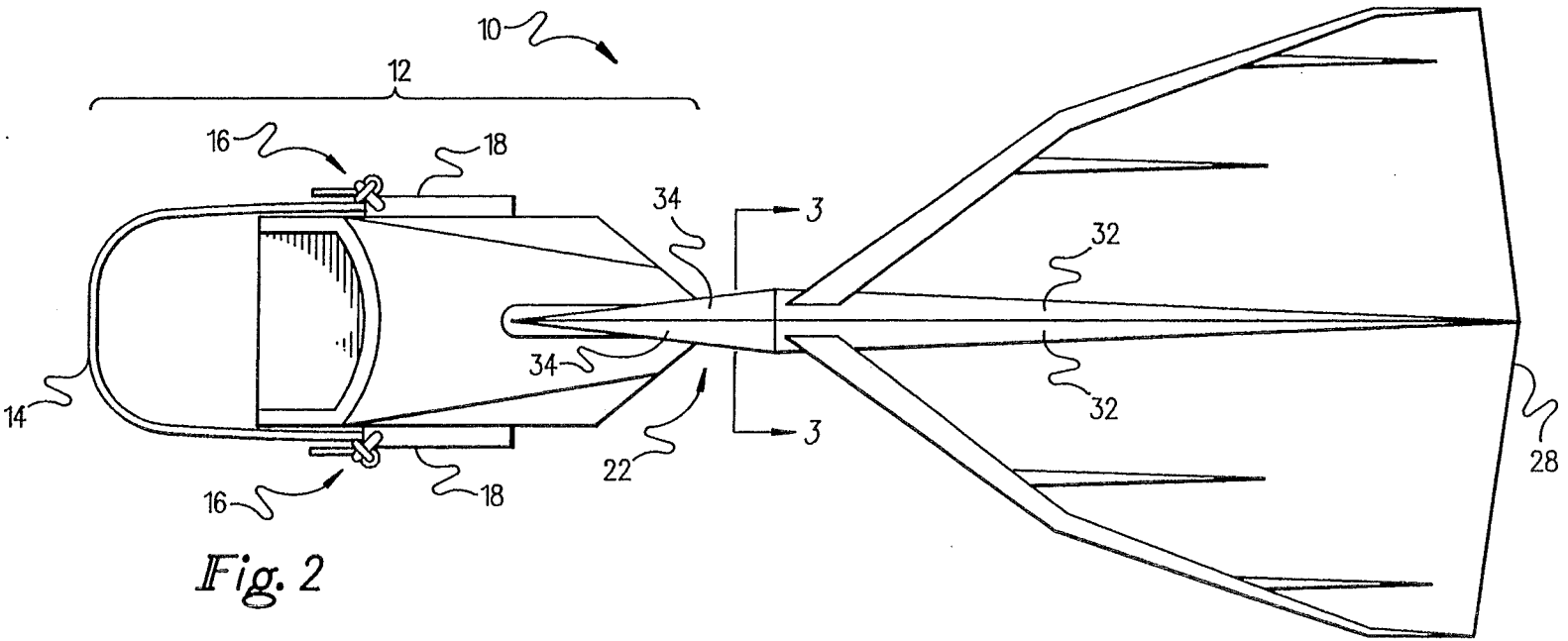
FIG. 2 is a top plan, diagrammatic view of the novel scuba fin.

Turning now to FIG. 1 of the drawings, the novel scuba fin 10 is seen to include a conventional foot pocket 12, heel strap 14, buckle 16, buckle attachment boss 18, and fin portion 20. With reference to FIG. 2, fin portion 20 is a separate member, delimited with respect to foot pocket 12, and is connected to foot pocket 12 by a caudal shaft 22.

"Caudal" shaft, as used herein is meant to define an interconnecting member of greatly reduced thickness (with respect to the widths of foot pocket 12 and the blade of fin portion 20), but of relatively substantial height, as seen in FIG. 1, thus to form a whale's fluke like interconnection, foot pocket to fin blade.

This arrangement enables realization of two benefits. Referring again to FIG. 1, it will be seen that fin portion 20 includes a longitudinal axis 24. Longitudinal axis 24 is roughly that line which equally divides fin portion 20 into top and bottom halves, and which is preferably parallel to upper and lower surfaces of fin portion 20. Foot pocket 12 has a bottom surface 26 which is offset from and at an angle to longitudinal axis 24, longitudinal axis 24 being upwardly inclined, such that the forward tip or edge 28 of fin portion 20 is maintained above the level of bottom surface 26. The result thus obtained helps ensure that tip or edge 20 not snag on an environmental surface, or a projection therefrom (neither shown). A diver freed from concentrating on walking is able to concentrate on other matters, and walks more quickly and efficiently. On the deck of a diving boat (not shown), the diver is now able to concentrate on balance and a task at hand.

Although scuba fin 10 preferably includes treads or cleats 30 for additional stability when walking on a solid surface, bottom surface 26 will be understood to be defined as a plane parallel to a flat environmental surface contacting scuba fin 10.

Caudal shaft 22 is best seen in FIG. 2 to comprise a member having forwardly inclined exposed surfaces 32 and rearwardly inclined exposed surfaces 34, with each of the exposed surfaces 32 and 34 preferably forming an acute angle of less than forty-five degrees with respect to the longitudinal axis 24. As employed herein, "inclined" will be understood to refer to surfaces which face a direction of motion with respect to ambient water which is neither normal nor perpendicular to the direction of motion. Of course, "forwardly" and "rearwardly" are defined with respect to the direction of a diver while swimming, walking, or otherwise moving.

Figure 3:
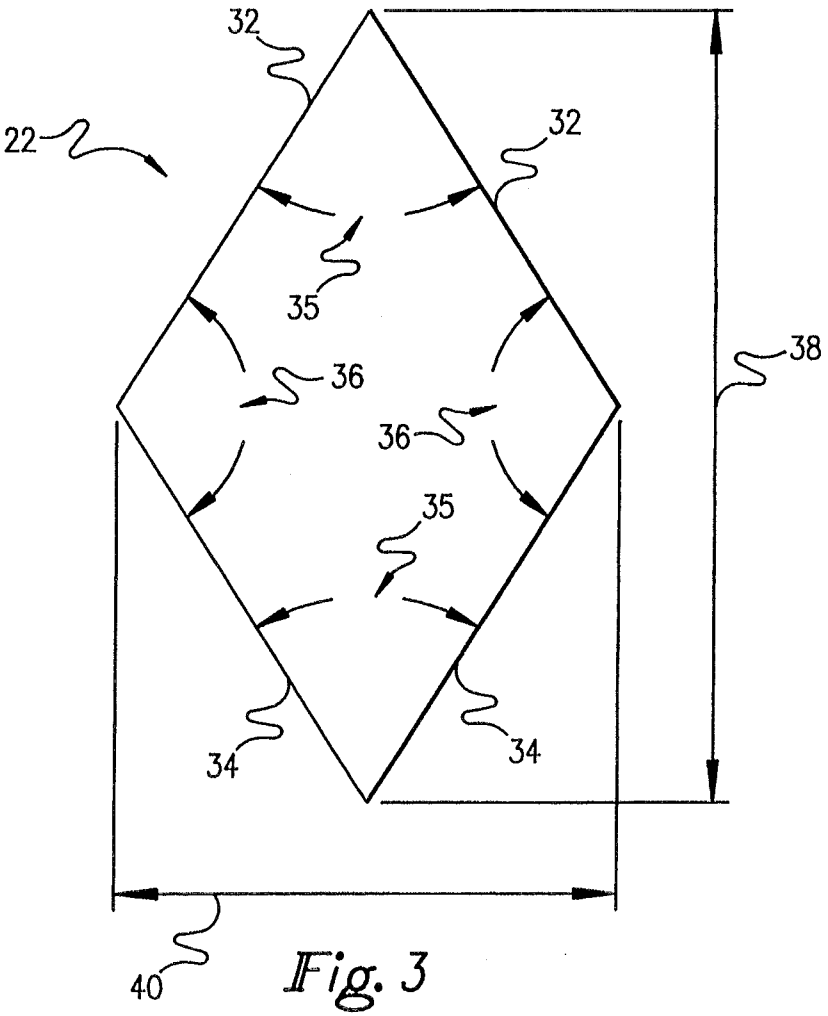
FIG. 3 is a diagrammatic, cross sectional detail view, taken along line 3—3 of FIG. 2, and drawn to enlarged scale.

Examination of a cross section of caudal shaft 22, best seen in FIG. 3, reveals that inclined surfaces 32 meet and describe two acute angles 35,35 and two obtuse angles 36,36 defining a substantially quadrilateral transverse cross-sectional shape. This geometry results in a caudal shaft height dimension 38, defined as that dimension extending between the two acute angles 35,35, being greater than a caudal shaft thickness dimension 40, defined as that dimension extending between the two obtuse angles 36,36. A hydrodynamic shape is thus obtained which enables caudal shaft 22 to pass efficiently through water.

Figure 4:
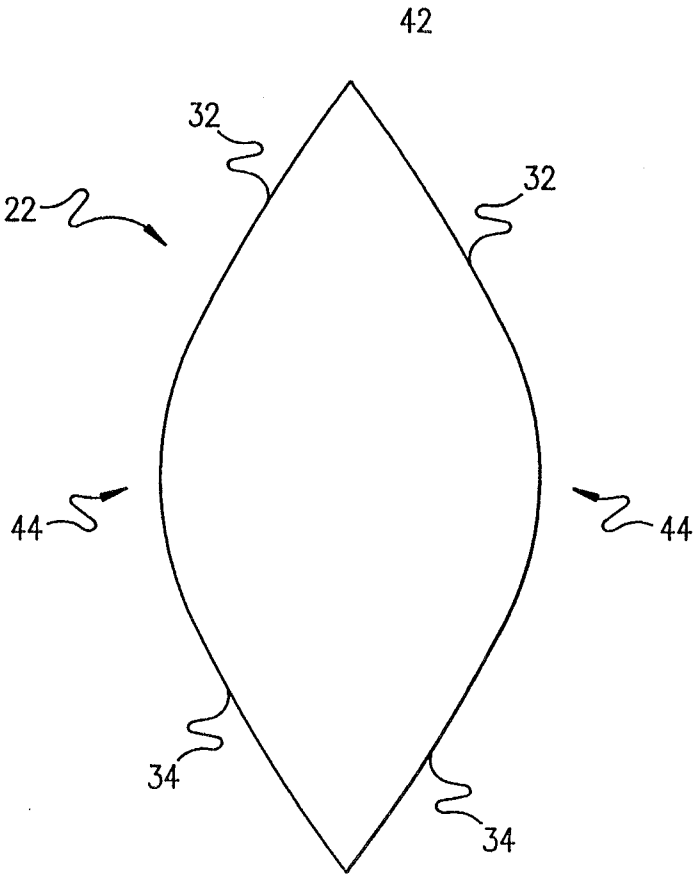
FIG. 4 is a diagrammatic, cross sectional detail view of an alternative embodiment of the member illustrated in FIG. 3, and drawn to enlarged scale.

Although the preferred embodiment is illustrated as comprising flat surfaces intersecting at lines forming included angles between adjacent surfaces, the present invention could be practiced by providing rounded surfaces and possibly eliminating certain sharp edges at joints existing between intersecting surfaces. Preferred locations for making such substitutions will be identified by those skilled in the art, such that flow of water around any one member is improved by a rounded surface or joint. An example is shown in FIG. 4, wherein caudal shaft 22 is configured to present a sharp forward edge 42 to incident water, there being rounded transitions 44,44 between frontal inclined surfaces 32 and 32, and rearward inclined surfaces 34 and 34.

It is to be understood that the present invention is not limited to the embodiments described above, but encompasses any and all embodiments within the scope of the following claims.

We claim:

1. A scuba fin having a foot pocket and a fin, said fin being delimited with respect to and separate from said foot pocket, and connected thereto by a caudal shaft having height and thickness dimensions, said caudal shaft having forwardly exposed surfaces which are inclined, said caudal shaft having a longitudinal axis, each of said inclined forwardly exposed surfaces forming an acute angle with respect to said longitudinal axis, said foot pocket including a bottom surface and said fin having a longitudinal axis offset from and inclined at an angle to said foot pocket bottom surface, such that a forward edge of said fin is maintained above said foot pocket bottom surface in an unflexed condition of said fin.

2. The scuba fin according to claim 1, each one of said acute angles being less than forty-five degrees.

3. The scuba fin according to claim 2, said caudal shaft also having rearwardly exposed surfaces which are inclined.

4. The scuba fin according to claim 3, each of said inclined rearwardly exposed surfaces forming an acute angle with respect to said longitudinal axis.

5. The scuba fin according to claim 4, each one of said acute angles formed by said inclined rearwardly exposed surfaces being less than forty-five degrees.

6. The scuba fin according to claim 2, said caudal shaft also having rearwardly exposed surfaces which are inclined, each of said inclined rearwardly exposed surfaces forming an acute angle with respect to said longitudinal axis.

7. The scuba fin according to claim 6, each one of said acute angles formed by said inclined rearwardly exposed surfaces being less than forty-five degrees, whereby said caudal shaft height dimension is greater than said caudal shaft thickness dimension.

8. The scuba fin according to claim 1, said caudal shaft height dimension being greater than said caudal shaft thickness dimension.

9. A scuba fin having a foot pocket including a bottom surface and a fin including a forward edge and a longitudinal axis, said fin being delimited with respect to and separate from said foot pocket and connected thereto by a caudal shaft having height and thickness dimensions, said caudal shaft having forwardly and rearwardly inclined surfaces and a caudal shaft longitudinal axis, each of said forwardly and rearwardly inclined surfaces forming an acute angle with respect to said caudal shaft longitudinal axis, and said fin longitudinal axis being offset with respect to and at an angle to said foot pocket bottom surface, such that a forward edge of said fin is maintained above said foot pocket bottom surface in an unflexed condition of said fin.

10. The scuba fin according to claim 9, each of said acute angles being less than forty-five degrees, whereby said caudal shaft length dimension is greater than said caudal shaft height dimension.

11. The scuba fin according to claim 9, said caudal shaft height dimension being greater than said caudal shaft thickness dimension.

12. A scuba fin comprising:

a foot pocket including a bottom surface;

a fin;

means for delimiting said fin from said foot pocket and for connecting said foot pocket to said fin and maintaining a forward edge of said fin above said foot pocket bottom surface in an unflexed condition of said fin;

said means for delimiting and connecting including means for reducing resistance to vertical movement of the fin in water; and said means for delimiting and connecting comprising a caudal shaft including intersecting forwardly and rearwardly inclined surfaces forming acute angles with respect to a longitudinal axis of said fin.

13. The scuba fin of claim 12, wherein said acute angles are each less than forty-five degrees.

14. The scuba fin of claim 12, wherein said means for delimiting and connecting comprises said caudal shaft having a height dimension greater than a thickness direction.

15. The scuba fin of claim 12, wherein said means for delimiting and connecting comprises said caudal shaft having a substantially quadrilateral transverse cross-sectional shape.

* * * * *

UNITED STATES PATENT AND TRADEMARK OFFICE
CERTIFICATE OF CORRECTION

PATENT NO. : 5,421,758

DATED June 6, 1995

INVENTOR(S) : Michael P. Watson and John K. Sigler, III

It is certified that error appears in the above-identified patent and that said Letters Patent is hereby corrected as shown below:

At column 1, line 10 of the Patent, after the word "practice" change the " , " to - . -.

At column 1, line 47 of the Patent, "U.S. Patent No. 5,183,859," should read - U.S. Patent No. 5,163,859, -.

Signed and Sealed this

Tenth Day of October, 1995

Bruce Lehman

*Attest:*

BRUCE LEHMAN

*Attesting Officer*

*Commissioner of Patents and Trademarks*